US006318084B1

(12) United States Patent
Schmidt et al.

(10) Patent No.: US 6,318,084 B1
(45) Date of Patent: Nov. 20, 2001

(54) INTERNAL-COMBUSTION ENGINE HAVING AN ENGINE BRAKING DEVICE

(75) Inventors: Erwin Schmidt, Baltmannsweiler; Siegfried Sumser, Stuttgart, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/390,318

(22) Filed: Sep. 7, 1999

(30) Foreign Application Priority Data

Sep. 5, 1998 (DE) ..... 198 40 639

(51) Int. Cl.[7] ..... F02D 23/00

(52) U.S. Cl. ..... 60/602; 123/321; 123/322; 364/431.04

(58) Field of Search ..... 60/602; 123/321, 123/322; 364/431.04

(56) References Cited

U.S. PATENT DOCUMENTS

| | | | | |
|---|---|---|---|---|
| 1,624,574 | * | 4/1927 | Beach | 60/602 |
| 4,697,558 | * | 10/1987 | Meneely | 123/321 |
| 5,119,633 | * | 6/1992 | Brooks et al. | 60/602 |
| 5,309,881 | * | 5/1994 | Pawellek et al. | 123/321 |
| 5,444,980 | * | 8/1995 | Dellora et al. | 60/602 |
| 5,462,025 | * | 10/1995 | Israel et al. | 123/321 |
| 5,485,819 | * | 1/1996 | Joko et al. | 123/321 |
| 5,540,201 | * | 7/1996 | Feucht et al. | 123/322 |
| 5,564,386 | | 10/1996 | Korte et al. | 123/321 |
| 5,735,242 | * | 4/1998 | Kahlenbeck et al. | 123/322 |
| 5,787,858 | | 8/1998 | Meneely | 123/321 |
| 6,062,025 | * | 5/2000 | Okada et al. | 60/602 |
| 6,085,524 | * | 7/2000 | Persson | 60/602 |

FOREIGN PATENT DOCUMENTS

| | | |
|---|---|---|
| 40 26 499 | 8/1991 | (DE) . |
| 44 33 258 | 3/1996 | (DE) . |
| 297 02 511 | 5/1997 | (DE) . |
| 0 599 322 | 6/1994 | (EP) . |
| WO 97/06355 | 2/1997 | (WO) . |

* cited by examiner

*Primary Examiner*—Thomas Denion
*Assistant Examiner*—Thai Ba Trieu
(74) *Attorney, Agent, or Firm*—Crowell & Moring LLP

(57) ABSTRACT

An internal-combustion engine has an engine braking device which has brake valves by way of which the combustion chamber content of the cylinders can be diverted in the engine braking phase. In the engine braking operation, the brake valves are changed into the opening position. In order to increase the operational reliability of the engine braking device, a blocking device is provided which acts upon the brake valves and which can be adjusted between a holding position and a release position. In the holding position of the blocking device, the brake valves are held in the opening position.

7 Claims, 1 Drawing Sheet

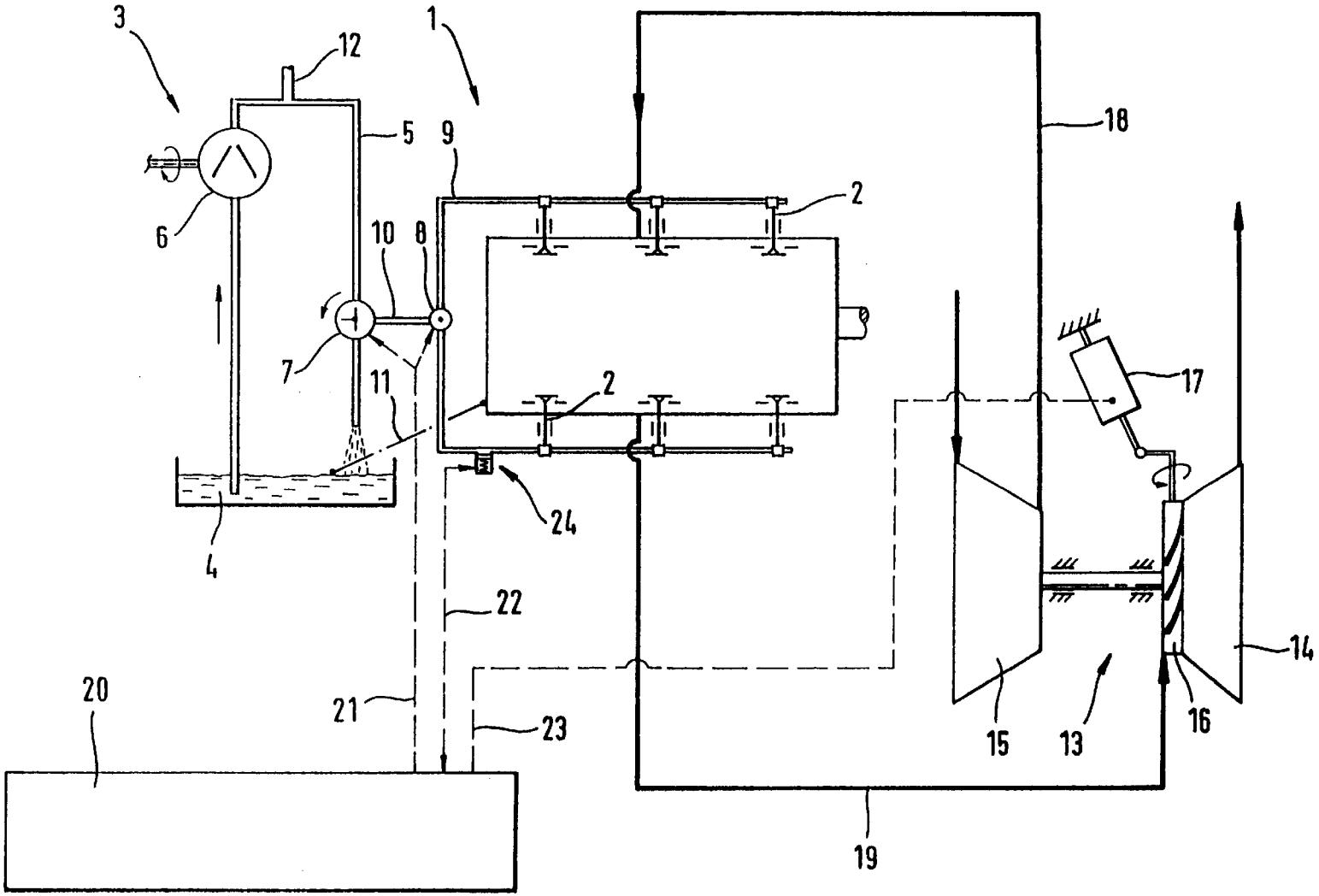
1
2
2
3
4
5
6
7
8
9
10
11
12
13
14
15
16
17
18
19
20
21
22
23
24

INTERNAL-COMBUSTION ENGINE HAVING AN ENGINE BRAKING DEVICE

BACKGROUND AND SUMMARY OF THE INVENTION

This application claims the priority of German patent 198 40 639.8, filed Sep. 5, 1998, the disclosure of which is expressly incorporated by reference herein.

The invention relates to an internal-combustion engine having an engine braking device which comprises brake valves by way of which, in the engine braking phase, the combustion chamber content of the cylinders can be diverted, the brake valves in the engine braking operation being changed into the opening position.

Engine braking systems are preferably used in heavy utility vehicles and consist of a switchable brake valve by way of which, in the engine braking operation, the combustion chamber content can be diverted into the atmosphere or into the exhaust pipe system. In the braking phase, the brake valves are changed into the opening position, the braking performance being generated by the friction-having flow of the combustion chamber gases through the valve opening of the brake valve.

At the high braking performances which can be generated and which, according to the used braking system, may amount to several hundred kW, relatively high rates of air flow and therefore high internal cylinder pressures are generated, which has the result that the brake valves are subjected to high dynamic loads and there is the risk that the operation of the brake valves may be impaired or the brake valves may even become inoperable. However, inoperable brake valves can severely impair the firing operation as well as the engine braking operation.

The invention is based on the problem of increasing the operational reliability of the engine braking device.

According to the invention, this problem is solved by providing a blocking device which acts upon the brake valves and which can be adjusted between a holding position and a release position, wherein in the holding position of the blocking device, the brake valves are held in the open position.

By way of the adjustable blocking device, the brake valves can be held in the opening position in the engine braking operation, whereby brake valve vibrations which may damage the valve are avoided, even at high internal cylinder pressures and correspondingly high flow rates of the combustion chamber content through the valve opening. The brake valves are steadied in their opening position during the engine braking operation and the danger of an impairment of their operation is reduced.

The brake valves are expediently held hydraulically in the opening position, in which case the blocking device can preferably also be operated hydraulically and supplies the brake valves with the necessary hydraulic control pressure. This has the advantage that the control medium of the blocking device is simultaneously the control medium for the brake valves and a no-delay, sensitive adjustment of the control pressure is permitted.

The hydraulic blocking device comprises a pump for conveying the hydraulic medium, a hydraulic supply line for the brake valves as well as an adjustable shut-off valve by way of which the hydraulic supply to the brake valves can be adjusted or blocked. In an advantageous further development, a prestressing device is provided by way of which the hydraulic medium for the brake valves can be acted upon by a definable desired pressure, and a pressure sensor is provided for measuring the hydraulic pressure. By way of the prestressing device, leakage currents can be compensated in the feed pipe supplying the brake valves or in the brake valves themselves. The pressure sensor is required for adjusting the hydraulic pressure to a defined desired value. The prestressing device may be constructed, for example, as a spring-supported piston which acts upon the hydraulic medium. The prestressing device and the pressure sensor may be integrated in a common constructional unit, whereby the construction volume is reduced.

The internal-combustion engine preferably has an exhaust gas turbocharger and a device for the variable adjustment of the exhaust gas back pressure, particularly a variable turbine geometry for the changeable adjustment of the turbine cross-section, in this embodiment, the combustion chamber content being blown off in the engine braking operation into the exhaust pipe system upstream of the turbine. By changing the turbine geometry, it is possible to implement pressures of different intensities in the section between the cylinders and the turbine, whereby the output of the turbine and the performance of the compressor can be adjusted according to the requirements.

In the braking operation of the internal-combustion engine, the turbine cross-section is clearly reduced, whereupon a high excess pressure is built up in the section between the cylinders and the exhaust gas turbocharger. The exhaust gas flows at a high rate through the narrowed-down turbine cross-section and acts upon the turbine wheel, whereupon the combustion air fed to the engine by the compressor is subjected to an excess pressure. An excess pressure also exists on the output side of the cylinder, which excess pressure counteracts the blowing-off of the air compressed in the cylinder by way of the brake valves into the exhaust pipe system. In the engine braking operation, the piston must carry out compression work in the compression stroke and push-out stroke against the high excess pressure in the exhaust pipe system, whereby a strong braking effect is achieved.

By means of the combination of the blocking device with the turbo braking system, it is possible to implement high air flow rates and correspondingly high internal cylinder pressures which are required for achieving high braking performances and to simultaneously prevent a vibration-caused wear of the brake valves.

By way of an automatic control unit, the activities of the turbine, of the brake valves and of the blocking device are preferably coordinated. Expediently, in the event of a braking performance demand by means of the adjusting signals generated by the automatic control unit, the turbine cross-section is reduced by means of the variable turbine geometry, the braking valves are opened simultaneously, the pressure in the blocking device is increased to the desired pressure, and finally the shut-off valve in the hydraulic supply pipe is closed in order to lock the brake valves in the opening position.

Other objects, advantages and novel features of the present invention will become apparent from the following detailed description of the invention when considered in conjunction with the accompanying drawings.

BRIEF DESCRIPTION OF THE DRAWINGS

The drawing FIGURE is a schematic view of an engine braking device and a blocking device for the brake valves of the engine brake according to a preferred embodiment of the present invention.

DETAILED DESCRIPTION OF THE DRAWINGS

The internal-combustion engine 1, particularly the internal-combustion engine of a utility vehicle, is equipped with an engine braking device for generating engine braking power. The engine braking device consists of brake valves 2 which are arranged at the cylinder output on each cylinder and which can be adjusted between an open position, which is assigned to the engine braking operation, and a closed position, which is assigned to the fired operation. In the engine braking operation, the brake valves 2 are in the open position and the combustion chamber content of the cylinders is diverted into the exhaust pipe system 19, the braking performance being generated by the frictional flow through the valve cross-section of the brake valves.

For controlling the brake valves 2 and particularly for the secure locking of the brake valves 2 in the engine braking phase in the open position, a blocking and control device 3 is provided which has the purpose of locking the brake valves 2 in their open position. The blocking device 3 is hydraulically constructed and comprises a reservoir 4 with hydraulic medium, a hydraulic supply pipe 5, a pressure pump 6, a throttle valve 7 in the supply pipe 5 as well as a shut-off valve 8.

By way of the hydraulic supply pipe 5, the hydraulic medium—as a rule, oil—delivered by the pump 6 is fed to the brake valves 2 which can be hydraulically adjusted between the open and closed position and are all supplied with hydraulic medium by a feed pipe 9. The feed pipe 9 is connected by way of a connection pipe 10 with the hydraulic supply pipe 5 of the blocking device 3. In the branch-off of the connection pipe 10 from the hydraulic supply pipe 5, the throttle valve 7 is arranged. The shut-off valve 8 is situated in the intersection point of the connection pipe 10 with the feed pipe 9.

For operating the brake valves, the pressure pump 6 is activated, whereupon hydraulic medium is delivered from the reservoir 4 by way of the supply pipe 5, the throttle valve 7, the connection pipe 10 and the opened shut-off valve 8 into the feed pipe 9 supplying the brake valves 2, so that the brake valves 2 are changed against the force of their brake valve springs into the opening position.

The pressure in the feed pipe 9 is measured by way of a pressure sensor. As soon as the pressure has reached a defined desired value, the shut-off valve 8 is closed and the feed pipe 9 is thereby shut off from the supply with hydraulic medium by way of the hydraulic supply pipe 5. As the result of the blocking of the feed pipe 9, the pressure in the feed pipe is fixed at the desired value; the brake valves are securely held in the open position.

Furthermore, a compensating tank 24 is provided which communicates with the feed pipe 9. The compensating tank 24 is acted upon by a prestressing device which is constructed, for example, as a piston which is acted upon by a spring with a hard characteristic spring curve. The prestressing device exercises a pressure on the hydraulic medium in the feed pipe 9, whereby, after the connection between the feed pipe 9 and the hydraulic supply pipe 5 is separated, particularly smaller leakage flows in the feed pipe 9 or in the brake valves 2 can be compensated and the pressure level can be maintained at the desired value.

It may also be expedient to uncouple the operation of the brake valves between the open position and the closed position from the blocking device. In this embodiment, the blocking device no longer has an adjusting function acting upon the brake valves but is used only for locking the brake valves in the open position.

According to another embodiment, the supply of the hydraulic medium to the brake valves is not shut-off but the hydraulic supply is maintained in the closed position as well as in the open position of the brake valves. The brake valves are opened and possibly also closed by way of the blocking device. The holding position is achieved by maintaining the pressure required for the opening without separating the feed pipe from the hydraulic supply. The brake valves are not locked in the open position by the blocking device but are only held. This embodiment can be implemented in a constructively simple manner.

The throttle valve 7 in the hydraulic supply pipe 5 can be switched to the idling position in which the hydraulic medium is only pumped over in the supply pipe 5. Furthermore, a branch-off 12 is provided in the supply pipe 5 by way of which additional consuming devices can be supplied with hydraulic medium.

Between the reservoir 4 and the engine, a connection 11 is schematically shown, which is to indicate that the reservoir 4 of the blocking device 3 may simultaneously be an oil tank of the engine.

For increasing the power, the internal-combustion engine comprises an exhaust gas turbocharger 13 with a turbine 14 in the exhaust pipe system 19 and a compressor 15 in the intake system 18. The exhaust gas back pressure upstream of the turbine 14 can be variably adjusted. For this purpose, the turbine 14 is equipped with a variably adjustable turbine geometry which, in the embodiment, is constructed as an axial slide turbine in the form of axially slidable guide baffles 16 which can be operated by an adjusting element 17. The turbine 14 is driven by the exhaust gases in the exhaust pipe system 19 which are subjected to the exhaust gas back pressure and, in turn, by way of a shaft, drives the compressor 15 which compresses the taken-in fresh air to an increased charge pressure. The compressed air is fed to the suction pipe of the internal-combustion engine, the rise in pressure resulting in an increase of the engine driving power.

In the engine braking operation, the exhaust gas turbocharger 13 is used for generating engine braking power. The axially displaceable guide baffles 16 of the turbine 14 are changed for this purpose into a ram position in which the effective turbine cross-section is reduced. A raised exhaust gas back pressure is then built up; the exhaust gas flows at an increased rate through the ducts between the guide blades of the guide baffles 16 and impacts on the turbine wheel driving the compressor 15, whereby the raised charge pressure is built up in the intake system 18. Simultaneously, the brake valves 2 on the cylinder outlet of the internal-combustion engine 1 are opened so that the air compressed in the cylinder can be blown off into the exhaust pipe system 19.

The braking performance can be influenced by the position of the guide baffles 16 and the resulting adjustment of the turbine inlet cross-section.

Instead of axially displaceable guide baffles, the variable turbine geometry can also be implemented by rotatable blades. The adjustment of the cross-section is carried out in this case by the rotation of the blades.

As an alternative to adjustable guide baffles, the turbine may be equipped with a flap in the inlet and acceleration ducts which start off upstream of the inlet and which end directly behind the open turbine backs. Also in this embodiment, the exhaust gas flow acting upon the turbine wheel is variably adjustable.

The internal-combustion engine 1 also comprises an automatic control unit 20 which, by way of signal lines 21, 22, 23, is connected with the valves 7, 8 of the blocking device 3, with the prestressing device and the pressure sensor of the feed pipe 9 and with the adjusting element 17 for adjusting the variable turbine geometry. As a function of engine and operating parameters and quantities and as a function of control or automatic control strategies, adjusting signals are generated in order to coordinate the functions of the blocking device, of the brake valves and of the exhaust gas turbocharger.

The opening and closing sequence of the brake valves as well as the operation of the exhaust gas turbocharger are implemented as follows.

As soon as the braking power is demanded by the engine brake, the turbine cross-section is reduced by way of the guide baffles 16 via the adjusting element 17. Simultaneously, the brake valves are changed into the open position by closing the throttle valve 7 so that a pumping over of hydraulic medium in the supply pipe 5 is prevented and by opening up the shut-off valve 8 so that the hydraulic medium of the supply pipe 5 can flow into the feed pipe 9. Then the feed pipe 9 as well as additional volumes in the brake valves 2 and the compensating tank 24 fill up with hydraulic medium, whereby the brake valves are opened against the force of their brake valve springs. The spring of the prestressing device, which acts upon the piston in the compensating tank 24, prestresses until the defined desired pressure is reached in the hydraulic system. The shut-off valve 8 is closed and the blocking device 3 is in the holding position in which the pressure in the feed pipe 9 is uncoupled from the pressure in the hydraulic supply pipe 5. As required, the throttle valve 7 is opened so that the hydraulic medium in the supply pipe 5 flows back into the reservoir 4.

The measuring of the system pressure in the feed pipe 9 can take place by way of the spring of the prestressing device.

For terminating the engine braking operation, the brake valves 2 are changed back into the closing position in that the blocking device 3 is changed into the release position. For this purpose, the shut-off valve 8 is opened up and a flow-back possibility is provided for the hydraulic medium from the feed pipe 9, so that the pressure can escape from the feed pipe 9 by way of the connection pipe 8 into the hydraulic supply pipe 5 or the reservoir 4 and the brake valve springs can close the brake valves. In an isochronous or delayed manner with respect to the closing of the brake valves, the narrowest turbine cross-section is opened up by the corresponding adjustment of the guide baffles 16 by way of the adjusting element 17. Then, the engine braking phase is terminated and the firing operation can start.

In addition to a hydraulic operation of the blocking device, a pneumatically, electrically or mechanically constructed blocking device can also be used.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal-combustion engine having an engine braking device, comprising:

an engine cylinder;

a hydraulically operated brake valve arranged at said cylinder, said brake valve being movable between an open position and a closed position; and a hydraulic blocking device operatively coupled via a throttle valve to said brake valve, said blocking device being adjustable between a holding position in which the brake valve is held in the open position and a release position, and comprising a hydraulic feed pipe communicating the hydraulic supply line with the brake valve, a pressure sensor which measures a pressure in the feed pipe and an adjustable shut-off valve for shutting-off the hydraulic supply communicating with the throttle valve.

2. The internal-combustion engine according to claim 1, wherein, in the open position of the brake valve, a combustion chamber content of the cylinder is communicated with an exhaust gas system of the internal-combustion engine.

3. The internal-combustion engine according to claim 2, further comprising an exhaust gas turbocharger with a turbine communicated with said exhaust gas system, an exhaust gas back pressure being variably adjustable upstream of the turbine of the exhaust gas turbocharger.

4. The internal-combustion engine according to claim 3, wherein the turbine has a variable turbine geometry for changeable adjustment of a cross-section of the turbine.

5. The internal-combustion engine according to claim 4, further comprising an automatic control unit which generates adjusting signals for operation at least one of the turbine cross-section, the brake valve, and the blocking device.

6. The internal-combustion engine according to claim 1, further comprising an automatic control unit which generates adjusting signals for operation at least one of the turbine cross-section, the brake valve, and the blocking device, wherein a pressure in the feed pipe is fed to the automatic control unit as an input signal.

7. An internal-combustion engine having an engine braking device, comprising:

an engine cylinder;

a brake valve arranged at said cylinder, said brake valve being movable between an open position and a closed position; and a blocking device operatively coupled to said brake valve, said blocking device being adjustable between a holding position in which the brake valve is held in the open position and a release position, further comprising a prestressing device for adjusting a desired pressure wherein the brake valve is hydraulically actuated and the blocking device comprises:

a hydraulic supply pump;

a hydraulic supply pipe communicating the pump with the brake valve; and an adjustable shut-off valve for shutting-off the hydraulic supply.

* * * * *